US009067295B2

(12) United States Patent
Deshpande et al.

(10) Patent No.: US 9,067,295 B2
(45) Date of Patent: Jun. 30, 2015

(54) MONITORING RETAINING RING THICKNESS AND PRESSURE CONTROL

(71) Applicant: Applied Materials, Inc., Santa Clara, CA (US)

(72) Inventors: Sameer Deshpande, Santa Clara, CA (US); Zhihong Wang, Santa Clara, CA (US); Samuel Chu-Chiang Hsu, Palo Alto, CA (US); Gautam Shashank Dandavate, Sunnyvale, CA (US); Hung Chih Chen, Sunnyvale, CA (US); Wen-Chiang Tu, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 5 days.

(21) Appl. No.: 13/791,761

(22) Filed: Mar. 8, 2013

(65) Prior Publication Data

US 2014/0027407 A1 Jan. 30, 2014

Related U.S. Application Data

(60) Provisional application No. 61/675,507, filed on Jul. 25, 2012.

(51) Int. Cl.

| | |
|---|---|
| ***B24B 37/005*** | (2012.01) |
| ***B24B 37/30*** | (2012.01) |
| ***B24B 49/10*** | (2006.01) |

(52) U.S. Cl.

CPC ..... *B24B 37/005* (2013.01); *B24B 37/30* (2013.01); *B24B 49/105* (2013.01)

(58) Field of Classification Search

CPC ..... B24B 37/005; B24B 49/105; B24B 37/30
USPC ..... 156/345.12, 345.13, 345.15, 345.16
See application file for complete search history.

(56) References Cited

U.S. PATENT DOCUMENTS

| | | | | |
|---|---|---|---|---|
| 6,159,073 | A | 12/2000 | Wiswesser et al. | |
| 6,251,215 | B1 * | 6/2001 | Zuniga et al. | 156/345.14 |
| 6,390,908 | B1 | 5/2002 | Chen et al. | |
| 6,602,724 | B2 * | 8/2003 | Redeker et al. | 438/5 |

(Continued)

FOREIGN PATENT DOCUMENTS

| | | |
|---|---|---|
| JP | 2001-035822 | 2/2001 |
| KR | 10-2008-0109119 | 12/2008 |

(Continued)

OTHER PUBLICATIONS

International Search Report and Written Opinion in International Application No. PCT/US2013/049269, mailed Oct. 18, 2013, 10 pages.

*Primary Examiner* — Sylvia R Macarthur
(74) *Attorney, Agent, or Firm* — Fish & Richardson P.C.

(57) ABSTRACT

A chemical mechanical polishing apparatus includes a carrier head including a retaining ring having a plastic portion with a bottom surface to contact a polishing pad, an in-situ monitoring system including a sensor that generates a signal that depends on a thickness of the plastic portion, and a controller configured to receive the signal from the in-situ monitoring system and to adjust at least one polishing parameter in response to the signal to compensate for non-uniformity caused by changes in the thickness of the plastic portion of the retaining ring.

18 Claims, 3 Drawing Sheets

(56) References Cited

U.S. PATENT DOCUMENTS

| | | | | |
|---|---|---|---|---|
| 6,924,641 | B1 | 8/2005 | Hanawa et al. | |
| 7,097,537 | B1 | 8/2006 | David et al. | |
| 7,112,960 | B2 | 9/2006 | Miller et al. | |
| 7,115,017 | B1 * | 10/2006 | Laursen et al. | 451/5 |
| 7,160,739 | B2 * | 1/2007 | Shanmugasundram et al. | 438/14 |
| 7,967,665 | B2 * | 6/2011 | Yasuda et al. | 451/285 |
| 2004/0005842 | A1 | 1/2004 | Chen et al. | |
| 2010/0099334 | A1 | 4/2010 | Bennett et al. | |
| 2010/0297916 | A1 * | 11/2010 | David et al. | 451/5 |
| 2011/0189925 | A1 | 8/2011 | Iravani et al. | |
| 2011/0195639 | A1 * | 8/2011 | Chen et al. | 451/41 |
| 2012/0048496 | A1 | 3/2012 | Rosen et al. | |
| 2013/0203321 | A1 * | 8/2013 | Chen et al. | 451/5 |
| 2014/0027407 | A1 * | 1/2014 | Deshpande et al. | 216/53 |

FOREIGN PATENT DOCUMENTS

| | | |
|---|---|---|
| KR | 10-2009-0039123 | 4/2009 |
| KR | 10-2011-0016970 | 2/2011 |

* cited by examiner

MONITORING RETAINING RING THICKNESS AND PRESSURE CONTROL

CROSS-REFERENCE TO RELATED APPLICATIONS

This application claims priority to U.S. Provisional Application Ser. No. 61/675,507, filed Jul. 25, 2012, the entire disclosure of which is incorporated by reference.

TECHNICAL FIELD

The present disclosure relates to monitoring the thickness of a retaining ring, e.g., during chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as a slurry with abrasive particles, is typically supplied to the surface of the polishing pad.

Some carrier heads include base and a membrane connected to the base that provides a pressurizable chamber. A substrate can be mounted on a lower surface of the membrane, and the pressure in the chamber above the membrane controls the load on the substrate during polishing.

The carrier head typically includes a retaining ring to prevent the substrate from slipping out from below the carrier head during polishing. Due to the friction of the polishing pad on the bottom surface of the retaining ring, the retaining ring gradually wears away and needs to be replaced. Some retaining rings have included physical markings to show when the retaining ring should be replaced.

SUMMARY

It can be difficult to determine when to replace a retaining ring that is not readily visible within the polishing system. However, a sensor can be used to determine the thickness of the wearable portion of the retaining ring.

As the retaining ring wears, the distance between the base of the carrier head and the polishing pad changes. As the ring wears, the distribution of pressure near the edge of the substrate can also change. Without being limited to any particular theory, this may be because the change in distance affects the distribution of force through the membrane. However, the thickness of the retaining ring as measured by the sensor can be used as an input to control a polishing parameter to compensate for the changes in polishing rate near the substrate edge.

In one aspect, a chemical mechanical polishing apparatus includes a carrier head including a retaining ring having a plastic portion with a bottom surface to contact a polishing pad, an in-situ monitoring system including a sensor that generates a signal that depends on a thickness of the plastic portion, and a controller configured to receive the signal from the in-situ monitoring system and to adjust at least one polishing parameter in response to the signal to compensate for non-uniformity caused by changes in the thickness of the plastic portion of the retaining ring.

Implementations can include one or more of the following features. The carrier head may include a plurality of chambers, and the at least one polishing parameter may include a pressure in at least one of the plurality of chambers. The at least one of the plurality of chambers may be a chamber that controls a pressure on an edge of a substrate held in the carrier head. The controller may be configured to decrease the pressure in the at least one of the plurality of chambers if the signal increases. The retaining ring may include a metal portion secured to a top surface of the plastic portion. The in-situ monitoring system comprises an eddy current monitoring system. A rotatable platen may support the polishing pad, and the sensor may be located in and rotate with the platen. The monitoring system may generate a sequence of measurements with each sweep, and the controller may be configured to identify one or more measurements made at one or more locations below the retaining ring. The controller may be configured to average measurements made at locations below the retaining ring. The controller may be configured to select a maximum or minimum measurement from a plurality of measurements made at locations below the retaining ring.

In another aspect, a chemical mechanical polishing apparatus includes a carrier head including a retaining ring having a plastic portion with a bottom surface to contact a polishing pad, an in-situ monitoring system including a sensor that generates a signal that depends on a thickness of the plastic portion, and a controller configured to receive the signal from the in-situ monitoring system and to determine a thickness of the plastic portion from the signal.

In another aspect, a method of controlling a polishing operation includes sensing a thickness of a plastic portion of a retaining ring in a carrier head used to hold a substrate against a polishing pad, and adjusting at least one polishing parameter in response to the sensed thickness to compensate for non-uniformity caused by changes in the thickness of the plastic portion of the retaining ring.

In another aspect, a non-transitory computer program product, tangibly embodied in a machine readable storage device, includes instructions to cause a polishing machine to carry out the method.

Implementations may optionally include one or more of the following advantages. The thickness of a wearable portion of a retaining ring can be sensed, e.g., without visual inspection of the retaining ring. The thickness of the retaining ring as measured by the sensor can be used as an input to control a polishing parameter to compensate for the changes in polishing rate near the substrate edge. Within-wafer and wafer-to-wafer thickness non-uniformity (WIWNU and WTWNU) can be improved. In addition, the retaining ring can provide acceptable uniformity at lower thicknesses. Consequently the lifetime of the retaining ring can be increased, thereby reducing operating costs.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
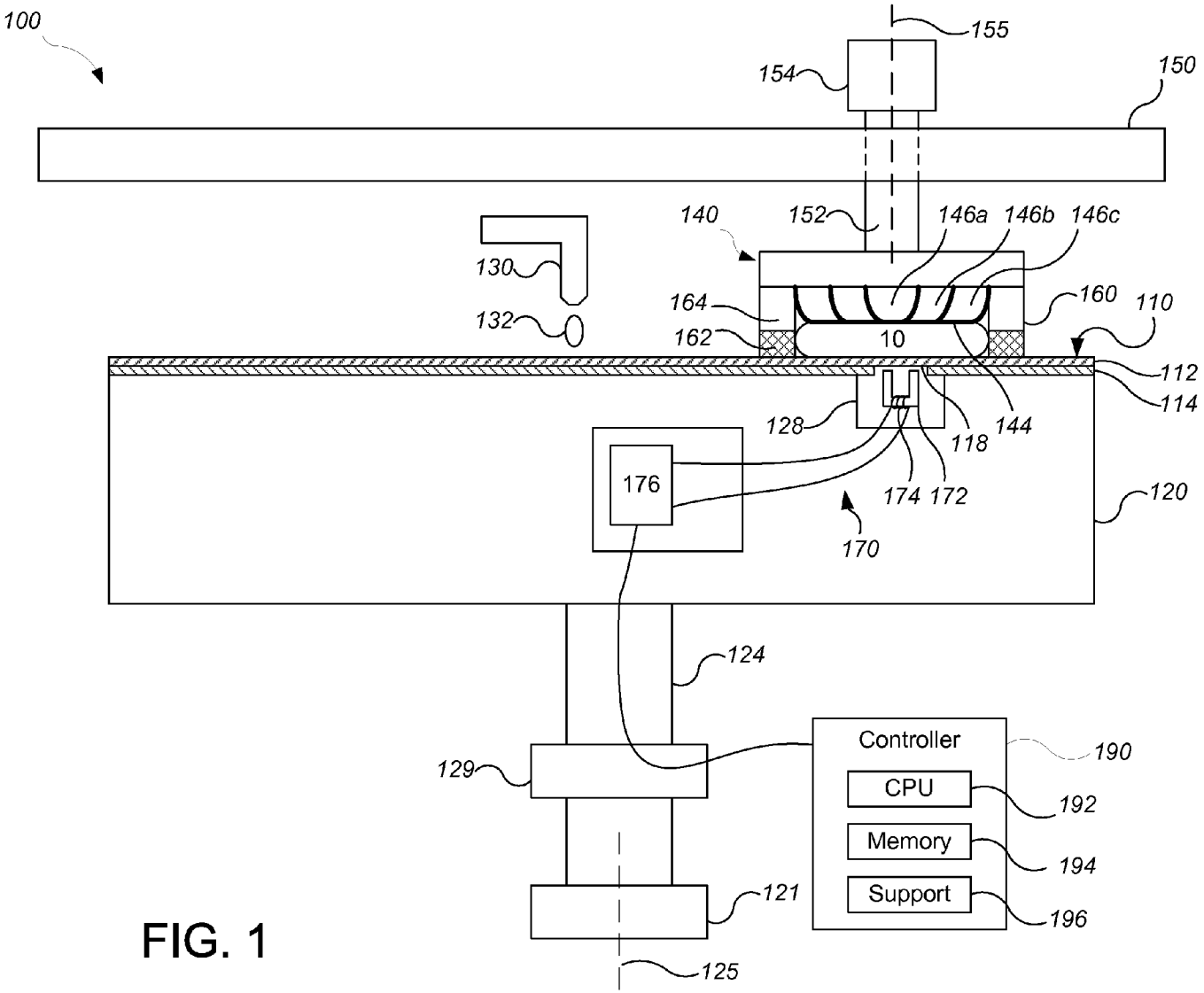
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as a slurry, onto the polishing pad 110. The polishing apparatus can also include a polishing pad conditioner to abrade the polishing pad 110 to maintain the polishing pad 110 in a consistent abrasive state.

The polishing apparatus 100 includes one or more carrier heads 140. Each carrier head 140 is operable to hold a substrate 10 against the polishing pad 110. Each carrier head 140 can have independent control of the polishing parameters, for example pressure, associated with each respective substrate.

Figure 2:
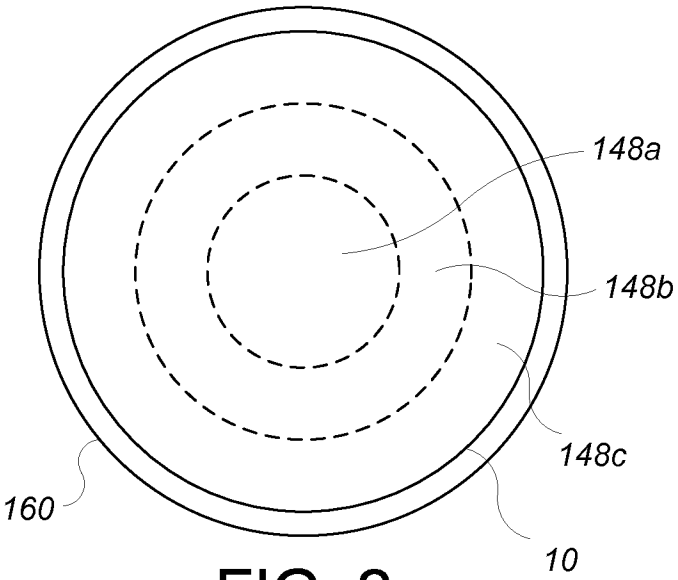
FIG. 2 illustrates a schematic top view of a substrate having multiple zones.

In particular, each carrier head 140 can include a flexible membrane 144 and a retaining ring 160 to retain the substrate 10 below the flexible membrane 144. Each carrier head 140 also includes a plurality of independently controllable pressurizable chambers defined by the membrane, e.g., three chambers 146*a*-146*c*, which can apply independently controllable pressures to associated zones 148*a*-148*c* on the flexible membrane 144 and thus on the substrate 10 (see FIGS. 1 and 2). Referring to FIG. 2, the center zone 148*a* can be substantially circular, and the remaining zones 148*b*-148*c* can be concentric annular zones around the center zone 148*a*. Although only three chambers are illustrated in FIGS. 1 and 2 for ease of illustration, there could be one or two chambers, or four or more chambers, e.g., five chambers.

Returning to FIG. 1, the retaining ring 160 includes a lower portion 162 and an upper portion 164. The lower portion 162 is a wearable plastic material, e.g., polyphenylene sulfide (PPS) or polyetheretherketone (PEEK), whereas the upper portion 164 is a metal, e.g., aluminum or stainless steel. The upper portion 164 is more rigid than the lower portion 162. A plurality of slurry-transport channels can be formed in the lower surface of the lower portion 162 to direct the polishing fluid inwardly to the substrate 10 being polished. The lower portion can have a thickness of about 0.1 to 1 inch. e.g., 100 to 150 mils. In operation, the lower portion 162 is pressed against the polishing pad 110, so the lower portion 162 tends to wear away.

Each carrier head 140 is suspended from a support structure 150, e.g., a carousel or track, and is connected by a drive shaft 152 to a carrier head rotation motor 154 so that the carrier head can rotate about an axis 155. Optionally each carrier head 140 can oscillate laterally, e.g., by motion of a carriage on the carousel or track 150; or by rotational oscillation of the carousel itself. In operation, the platen is rotated about its central axis 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

The polishing apparatus also includes a monitoring system 170 configured to generate a signal that depends on a thickness of the lower portion 162 of the retaining ring 160. In one example, the monitoring system 170 is an eddy current monitoring system. The eddy current monitoring system can also be used to monitor the thickness of a conductive layer being polished on the substrate 10. Although FIG. 1 illustrates an eddy current monitoring system, other types of sensors could be used, e.g., acoustic, capacitive or optical sensors, that are capable of generating a signal that depends on the thickness of the lower portion 162. A sensor of the monitoring system 170 can be positioned in a recess 128 in the platen 120. In the example of the eddy current monitoring system, the sensor can include a core 172 and drive and sense coils 174 wound around the core 172. The core 172 is a high magnetic permeability material, e.g., a ferrite. The drive and sense coils 174 are electrically connected to driving and sensing circuitry 176. For example, the driving and sensing circuitry 176 can include an oscillator to drive the coil 174. Further details regarding an eddy current system and driving and sensing circuitry can be found in U.S. Pat. Nos. 7,112,960, 6,924,641, and U.S. Patent Publication No. 2011-0189925, each of which is incorporated by reference.

Although FIG. 1 illustrates a single coil 174, the eddy current monitoring system could use separate coils for driving and sensing the eddy currents. Similarly, although FIG. 1 illustrates a U-shaped core 172, other core shapes are possible, e.g., a single shaft, or three or more prongs extending from a backing piece. Optionally a portion of the core 172 can extend upwardly above the top surface of the platen 120 and into a recess 118 in the bottom of the polishing pad 110. If the polishing system 100 includes an optical monitoring system, then the recess 118 can be located in a transparent window in the polishing pad, a portion of the optical monitoring system can be located in the recess 128 in the platen, and the optical monitoring system can direct light through the window.

The output of the circuitry 176 can be a digital electronic signal that passes through a rotary coupler 129, e.g., a slip ring, in the drive shaft 124 to a controller 190. Alternatively, the circuitry 176 could communicate with the controller 190 by a wireless signal.

The controller 190 can include a central processing unit (CPU) 192, a memory 194, and support circuitry 196, e.g., input/output circuitry, power supplies, clock circuits, cache, and the like. The memory is connected to the CPU 192. The memory is a non-transitory computable readable medium, and can be one or more readily available memory such as random access memory (RAM), read only memory (ROM), floppy disk, hard disk, or other form of digital storage. In addition, although illustrated as a single computer, the controller 190 could be a distributed system, e.g., including multiple independently operating processors and memories.

In some implementations, the sensor of the in-situ monitoring system 170 is installed in and rotates with the platen 120. In this case, the motion of the platen 120 will cause the sensor to scan across each substrate. In particular, as the platen 120 rotates, the controller 190 can sample the signal from the sensor, e.g., at a sampling frequency. The signal from the sensor can be integrated over a sampling period to generate measurements at the sampling frequency.

Figure 3:
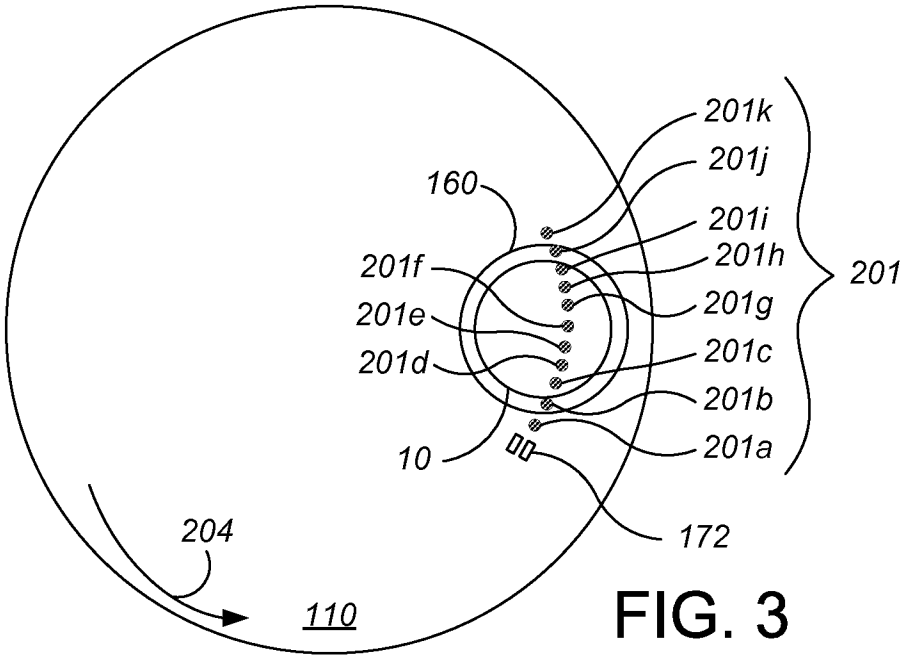
FIG. 3 illustrates a top view of a polishing pad and shows locations where in-situ measurements are taken on a substrate.

As shown by in FIG. 3, if the sensor is installed in the platen, due to the rotation of the platen (shown by arrow 204), as the sensor, e.g., the core 172, travels below a carrier head, the monitoring system 170 takes measurements at locations 201 in an arc that traverses the substrate 10 and the retaining ring 160. For example, each of points 201*a*-201*k* represents a location of a measurement by the monitoring system (the number of points is illustrative; more or fewer measurements can be taken than illustrated, depending on the sampling frequency).

As shown, over one rotation of the platen, measurements are obtained from different radii on the substrate 10 and the retaining ring 160. That is, some measurements are obtained from locations closer to the center of the substrate 10, some measurements are obtained from locations closer to the edge of the substrate 10, and some measurements are obtained from locations under the retaining ring.

Figure 4:
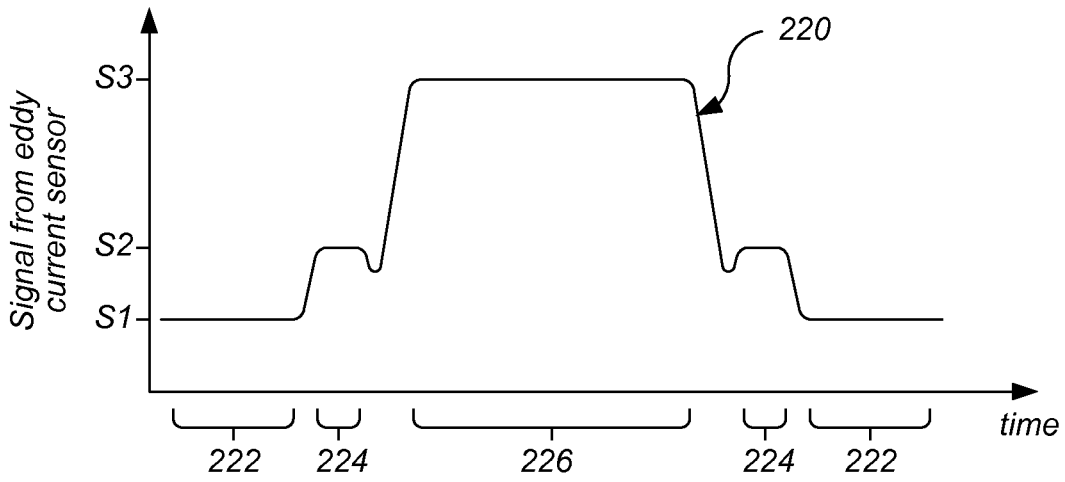
FIG. 4 illustrates a signal from the in-situ monitoring system as the sensor scans across the substrate.

FIG. 4 illustrates a signal 220 from an eddy current sensor during scan across a substrate. In portions 222 of the signal 220, the sensor is not proximate to the wafer (the sensor is "off-wafer"). Because there is no conductive material nearby, the signal starts at a relatively low value S1. In portions 224 of the signal 220, the sensor is proximate to the retaining ring. Because the retaining ring 160 includes a conductive upper portion 164, the amplitude of the signal 220 (relative to the off-wafer portion 222) increases to a relatively higher value S2. In the portions 226 of the signal, the sensor is proximate to the wafer (the sensor is "on-wafer"). In this portion 226, the signal will have an amplitude S3 that depends on the presence and thickness of a metal layer on the substrate. In the example shown in FIG. 4, the substrate includes a relatively thick conductive layer, so that S3 is greater than S2 . However, S3 might be higher or lower than the S2 depending on the presence and thickness of the metal layer.

The controller 190 can be configured to determine which measurements are taken at locations below the retaining ring and to store the measurements.

Which portion of the continuous signal from the sensor corresponds to the substrate, the retaining ring and the off-wafer zone can be determined based on the platen angular position and carrier head location, e.g., as measured by a position sensor and/or motor encoder. For example, for any given scan of the sensor across the substrate, based on timing, motor encoder information, and/or optical detection of the edge of the substrate and/or retaining ring, the controller 190 can calculate the radial position (relative to the center of the substrate being scanned) for each measurement from the scan. The polishing system can also include a rotary position sensor, e.g., a flange attached to an edge of the platen that will pass through a stationary optical interrupter, to provide additional data for determination of the position of the measurements. In some implementations, the time of measurement of the spectrum can be used as a substitute for the exact calculation of the radial position. Determination of the radial position of a measurement is discussed in U.S. Pat. Nos. 6,159,073 and 7,097,537, each of which is incorporated by reference.

The controller 190 can associate measurements that fall within a predetermined radial zone, which is known from the physical dimensions of the retaining ring 160, with the retaining ring.

In some implementations, which could be combined with approaches above, the portion of the signal corresponding to the retaining ring is determined based on the signal itself. For example, the controller 190 can be configured with a signal processing algorithm to detect a sudden change in signal strength. This sudden change can be used as indicating the shift to a different portion of the signal. Other techniques for detecting a different portion of the signal include changes in slope and threshold values in amplitude.

Where there are multiple measurements taken at positions below the retaining ring, the measurements can be combined, e.g., averaged. Alternatively, for a given sweep, a measurement from the multiple measurements can be selected, e.g., the highest or lowest measurement out of the multiple measurements can be used.

In some implementations, measurements made over multiple sweeps can be combined, e.g., averaged, or a measurement from the multiple sweeps can be selected, e.g., the highest or lowest measurement out of the measurements from multiple sweeps can be used.

In some implementations, measurements made over multiple substrates can be combined, e.g., averaged, or a measurement from the multiple substrates can be selected, e.g., the highest or lowest measurement out of the measurements from multiple substrates can be used. In some implementations, the retaining ring is monitored in less than all of the substrates being polished. For example, a measurement of the thickness of the lower portion of the retaining ring can be generated once every five substrates polished.

In addition, in some implementations, the controller associates the various measurements that are interior to the predetermined radial zone with the controllable zones 148*b*-148*c* (see FIG. 2) on the substrate 10.

Figure 5:
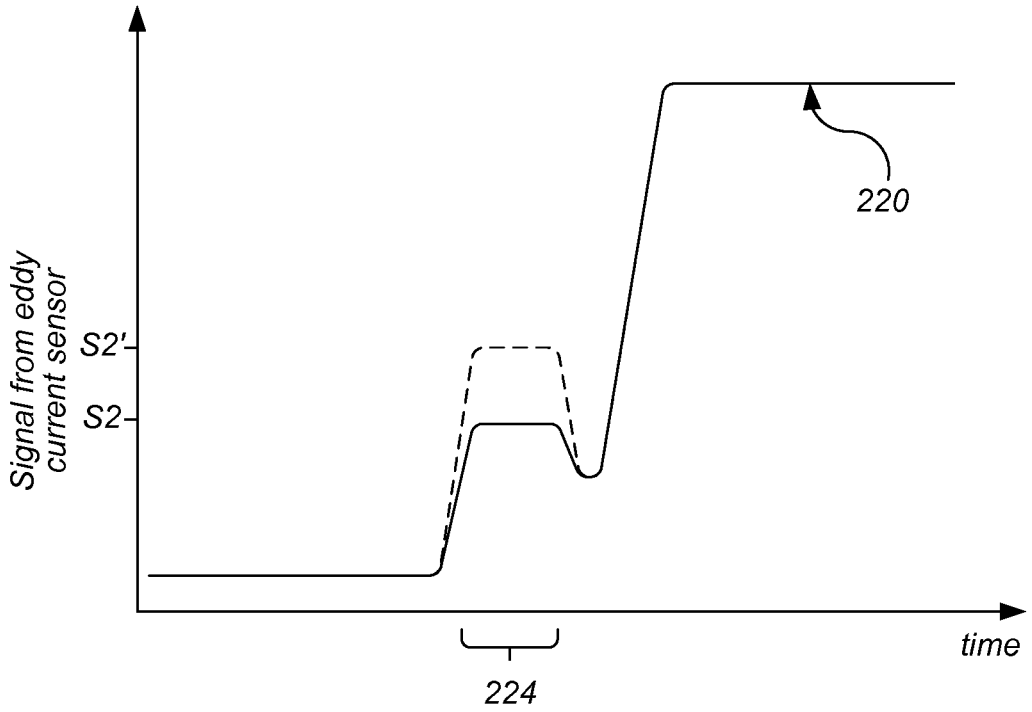
FIG. 5 illustrates a change in the signal due to wear of the retaining ring.

Over the course of polishing multiple substrates, the lower portion 162 of the retaining ring is worn away. Because the retaining ring 160 is pressed into contact with the polishing pad 110, as the retaining ring wears the metal upper portion 164 will gradually move closer to the platen 120. Consequently the strength of the signal as measured below the substrate will change, e.g., increase. For example, as shown in FIG. 5, a portion 224 of the signal 220 where the sensor is proximate to a new retaining ring can have a signal intensity S2, and the portion of the signal where the sensor is proximate to a worn retaining ring can have a different, e.g., higher signal intensity S2'.

In addition, the controller 190 can be configured to adjust one or more polishing parameters in order to compensate for effect of retaining ring wear on the polishing rate at the substrate edge. In particular, the signal intensity S2, S2' corresponding to the retaining ring can be used by the controller 190 as an input to a function that sets the polishing parameters.

For example, the controller 190 can be configured to adjust the pressure applied to the outermost region 148*c* , e.g., the pressure applied by the outermost chamber 146*c*. For example, if wear of the retaining ring results in an increase in the polishing rate at the substrate, the controller can reduce the pressure applied to the outermost region 148*c* of the substrate 10. In this case, the function that sets the pressure to the outermost region 148*c* takes the signal intensity S2 as an input, and the function is selected such that it outputs a desired pressure that decreases if S2 increases. Conversely, if wear of the retaining ring results in a decrease in the polishing rate at the substrate edge, the controller can increase the pressure applied to the outermost region 148*c* of the substrate 10. In this case, the function that sets the pressure to the outermost region 148*c* takes the signal intensity S2 as an input, and the function is selected such that it outputs a desired pressure that increases if S2 increases.

Depending on the configuration of the monitoring circuitry, the signal intensity can actually decrease as the retaining ring wears. In this case, the functions can be adjusted appropriately, e.g., if wear of the retaining ring results in an increase in the polishing rate at the substrate, then the function that sets the pressure is selected such that it outputs a desired pressure that decreases if S2 decreases.

Whether wear of the retaining ring increases or decreases the polishing rate at the substrate edge, and the amount of the decrease relative to the signal intensity S2, can be determined by empirical measurement. For example, a set of test substrates can be polished without performing compensation but using retaining rings 160 with different thicknesses for the lower portion 162. The signal intensities S2 for the different thicknesses of the lower portion 162 can be monitored, the center versus edge thickness difference for the layer being polished can be measured, e.g., at an in-line or separate metrology station. Presuming a Prestonian model in which the polishing rate is proportional to the pressure, the collected data can provide a function, e.g., a look-up table, that generates a correction for the pressure based on the signal intensity.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims.

What is claimed is:

1. A chemical mechanical polishing apparatus, comprising:

a carrier head including a retaining ring having a plastic portion with a bottom surface to contact a polishing pad;

a platen to support the polishing pad;

an in-situ monitoring system including a sensor that generates a signal during a polishing operation while the bottom surface of the plastic portion contacts the polishing pad, wherein the signal depends on a thickness of the plastic portion, and wherein the sensor is supported by the platen at a position below the polishing surface positioned on a side of the polishing pad farther from the retaining ring; and a controller configured to receive the signal from the in-situ monitoring system and to adjust at least one polishing parameter in response to the signal to compensate for nonuniformity caused by changes in the thickness of the plastic portion of the retaining ring.

2. The apparatus of claim 1, wherein the carrier head comprises a plurality of chambers, and the at least one polishing parameter comprises a pressure in at least one of the plurality of chambers.

3. The apparatus of claim 2, wherein the at least one of the plurality of chambers comprises a chamber that controls a pressure on an edge of a substrate held in the carrier head.

4. The apparatus of claim 3, wherein the controller is configured to decrease the pressure in the at least one of the plurality of chambers if the signal increases.

5. The apparatus of claim 1, wherein the retaining ring includes a metal portion secured to a top surface of the plastic portion.

6. The apparatus of claim 5, wherein the in-situ monitoring system comprises an eddy current monitoring system.

7. The apparatus of claim 6, wherein the platen comprises a rotatable platen to support the polishing pad, and wherein the sensor includes a core that is located in and rotates with the platen.

8. The apparatus of claim 7, wherein the eddy current monitoring system generates a sequence of measurements with each sweep, and wherein the controller is configured to identify one or more measurements made at one or more locations below the retaining ring.

9. A chemical mechanical polishing apparatus, comprising:

a carrier head including a retaining ring having a plastic portion with a bottom surface to contact a polishing pad;

a rotatable platen to support the polishing pad;

an in-situ monitoring system including a sensor that generates a signal while the bottom surface of the plastic portion contacts the polishing pad, wherein the signal depends on a thickness of the plastic portion, and wherein the sensor is located in and rotates with the platen; and a controller configured to receive the signal from the in-situ monitoring system and to adjust at least one polishing parameter in response to the signal to compensate for non-uniformity caused by changes in the thickness of the plastic portion of the retaining ring.

10. The apparatus of claim 9, wherein the in-situ monitoring system generates a sequence of measurements with each sweep, and wherein the controller is configured to identify one or more measurements made at one or more locations below the retaining ring.

11. The apparatus of claim 10, wherein the controller is configured to average measurements made at locations below the retaining ring.

12. The apparatus of claim 10, wherein the controller is configured to select a maximum or minimum measurement from a plurality of measurements made at locations below the retaining ring.

13. The apparatus of claim 10, wherein the controller is configured to combine measurements made from multiple sweeps of the sensor.

14. The apparatus of claim 10, wherein the controller is configured to select from measurements made from multiple sweeps of the sensor.

15. The apparatus of claim 10, wherein the controller is configured to combine or select from measurements made from sweeps of the sensor across multiple substrates.

16. The apparatus of claim 15, wherein the controller is configured to combine or select from measurements of multiple substrates that are not consecutively polished.

17. The apparatus of claim 16, wherein the controller is configured to combine or select from measurements from substrates selected periodically from a plurality of substrates being polished.

18. A chemical mechanical polishing apparatus, comprising:

a carrier head including a retaining ring having a plastic portion with a bottom surface to contact a polishing pad;

a platen to support the polishing pad;

an in-situ monitoring system including a sensor that generates a signal during a polishing operation while the bottom surface of the plastic portion contacts the polishing pad, wherein the signal depends on a thickness of the plastic portion, and wherein the sensor is supported by the platen at a position below the polishing surface positioned on a side of the polishing pad farther from the retaining ring; and a controller configured to receive the signal from the in-situ monitoring system and to determine the thickness of the plastic portion from the signal.

* * * * *